United States Patent [19]

Royset

[11] Patent Number: 5,035,662

[45] Date of Patent: Jul. 30, 1991

[54] ARRANGEMENT IN CONNECTION WITH AZIMUTH PROPELLER DRIVE MEANS FOR SHIPS

[75] Inventor: Norvald Royset, Hareid, Norway

[73] Assignee: Ulstein Propeller A/S, Ulsteinvik, Norway

[21] Appl. No.: 435,444

[22] PCT Filed: Apr. 27, 1989

[86] PCT No.: PCT/NO89/00039

§ 371 Date: Nov. 27, 1989

§ 102(e) Date: Nov. 27, 1989

[87] PCT Pub. No.: WO89/10299

PCT Pub. Date: Nov. 2, 1989

[30] Foreign Application Priority Data

Apr. 29, 1988 [NO] Norway ..... 881909

[51] Int. Cl.[5] ..... B63H 3/00

[52] U.S. Cl. ..... 440/50; 440/58

[58] Field of Search ..... 114/151; 440/2, 50, 440/53, 58, 59; 116/26

[56] References Cited

U.S. PATENT DOCUMENTS 3,552,348 1/1971 Shima .

4,392,832 7/1983 Moberg ..... 440/50

FOREIGN PATENT DOCUMENTS 8494 1/1983 Japan ..... 440/50

192696 8/1988 Japan ..... 440/2

132583 8/1975 Norway .

*Primary Examiner*—Jesus D. Sotelo

[57] ABSTRACT

An arrangement in connection with an azimuth propeller for ships to measure the angle between the rotational axis of the propeller and the longitudinal axis of the ship (azimuth angle), and the angle of attack of the propeller blades. The azimuth propeller comprises a first housing (1) which is firmly connected with the ship, and a second housing (2) which is rotatably mounted in first housing (1). A first drive shaft (6) extends through the first housing and is connected with a drive shaft (11) of a propeller (13) with variable pitch blades (14), said drive shaft extending at an angle to the first drive shaft. A first rod (31) extends through propeller shaft (11) and is in connection with the propeller blades and is movable with them. To transmit the rod movement to a display means for the angle of attack of the propeller blades a tube (40) is provided to extend coaxially through first drive shaft (6) and is, via an arm system (33, 41, 42), connected with first rod (31), and for display of the azimuth angle a second rod (43) extends through tube (40) and is firmly connected with second housing (2).

6 Claims, 1 Drawing Sheet

ARRANGEMENT IN CONNECTION WITH AZIMUTH PROPELLER DRIVE MEANS FOR SHIPS

Figure 1:
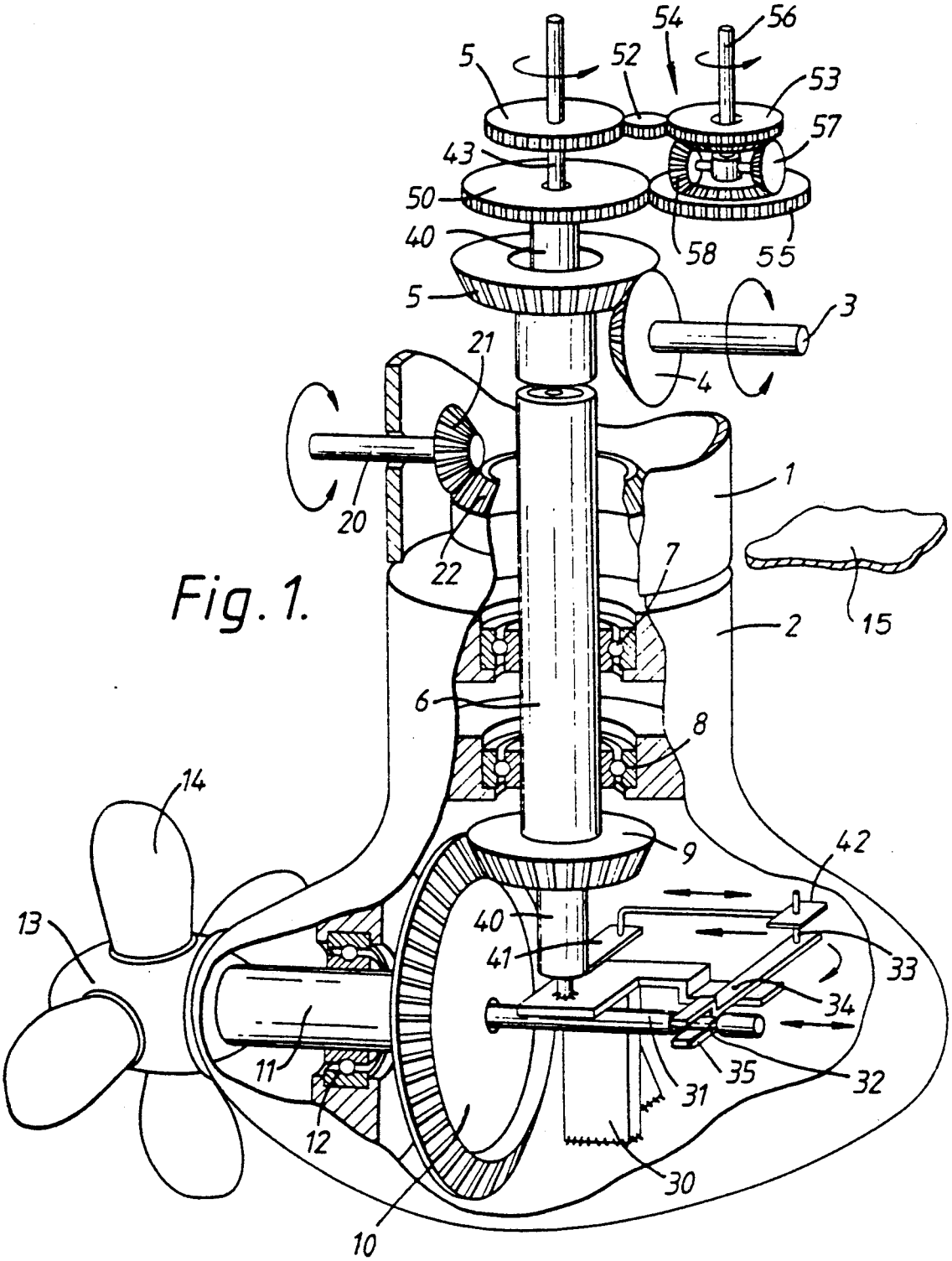

The invention relates to an arrangement in connection with azimuth propeller drive means for ships, to measure the angle between the rotational axis of the propeller and the longitudinal axis of the ship, and the angle of attack of the propeller blades, with the azimuth propeller drive means comprising a first housing which is provided to be firmly connected with the ship, and a second housing which is mounted in said first housing and is provided to be rotatable in relation to the latter, and where a first drive shaft extends through said first housing and into said second housing, and is connected with the ship's engine, and where a second drive shaft is mounted in said second housing and carries a propeller, and extends at an angle to and is driven by the first mentioned drive shaft, with the angle of attack of the propeller blades being adjustable by the aid of a servo, and where a first rod extends through and coaxially with said second drive shaft and is connected with elements of the servo in such a manner that one of said elements can be displaced in relation to the second drive shaft.

Propeller drive means of this kind are intended for providing a variable thrust, and for permitting adjustment of the sense of direction of said thrust in relation to the longitudinal axis of the ship, also called azimuth angle, so that the ship may, thus, be maneuvered.

Since the angle of attack of the propeller blades and the azimuth angle cooperate with other control parameters for modern vessels, it is important to the ship's crew to be currently informed on the magnitude of said angles.

In connection with ships it is known to use feedback from the controlled members, for confirmation that said members are really in the desired position, instead of assuming that such a position was reached, based on the maneuvering members of the control means.

In case of azimuth propeller drive means it is known to transfer the movement of said first rod to the ship by the aid of a rod extending side-by-side along said first drive shaft. Since the second housing is provided to be rotatable relative to the first housing in such a manner that its axis of rotation coincides with the rotational axis of the first drive shaft, it will be necessary to use a relatively complicated structure to transfer the movement of the rod from the rotatable housing to the stationary housing.

In known azimuth propeller drive means, furthermore, electronic measuring means are known which sense displacement of said first rod and, thus, measure the angle of attack of the propeller blades. This device is simple and inexpensive, but comparatively sensitive, and the consequences in case of a possible failure are great, since the ship must commonly be docked for repair.

If electric means are used to sense the angle of attack of the propeller blades, and the azimuth angle, respectively, said angles may be shown in a simple manner by arranging for the electric signals to be transmitted to respective display means. If rods are used which rise vertically through the first housing, and the rotation of which is a function of the angle of attack of the propeller blades, and the azimuth angle, respectively, a device is required which compensates for any simultaneous rotation of the second housing, i.e. the azimuth angle, to provide a correct display of the angle of attack of the propeller blades.

It is an object of the present invention to provide a measuring arrangement of the above mentioned kind, which does not show the above disadvantages.

What is characteristic of the measuring device according to the invention will appear from the characterizing features stated in the claims.

In the following, the invention is disclosed in more detail with reference to the drawings.

( FIGS. 1 and 2 are diagrammatical views of two embodiments according to the invention, where portions of the drive means are removed.

As will appear from the figures, the propeller drive means comprises a first tube-shaped housing 1, and a second housing 2. The first housing 1 is mainly provided inside the ship and is fixed to a portion of the hull which is positioned below the waterline, with the longitudinal axis of the housing extending substantially normal to mantle 15 of said portion of the hull. The second housing 2 is substantially provided outside the ship and is rotatably connected with first housing 1. It is assumed in the following that first housing 1 is connected with the bottom of the ship, and that the longitudinal axis of first housing 1 is vertical. A drive shaft 3 which is connected with the ship's engine is, via a gear 4, engaged with a gear 5 which is in turn fixed to upper end portion of a vertical drive shaft 6 extending down through first housing 1 and into second housing 2. Drive shaft 6 is mounted in two bearings 7, 8 in second housing 2, so that the rotational axis of the latter coincides with the longitudinal axis of drive shaft 6. A gear 9 is firmly secured to lower end portion of the vertical drive shaft, and is engaged with a gear 10. The latter is, in turn, firmly secured to the front end portion of a propeller drive shaft 11, which is mounted in the second housing by the aid of bearings 12. Propeller drive shaft 11 extends in a sealed manner through rear portion of second housing 2, and is provided with a propeller 13 with variable pitch propeller blades 14. In the propeller hub, a hydraulic servo (not shown) is provided for adjustment of the angle of attack of the blades. The servo may be supplied with hydraulic compressed oil, via conduits (not shown) etc., in a manner known per se.

A shaft 20 which is connected with the steering gear, extends into first housing 1, and has a gear 21 which engages teeth 22 which are, in turn, firmly secured to upper portion of second housing 2. The latter may be turned by turning shaft 20, so that the azimuth angle and, thus, the sense of thrust of the propeller drive means may be adjusted.

Through a coaxial bore in propeller drive shaft 11 a first rod 31 extends and may be mounted, e.g. in the propeller drive shaft, and is connected with elements of the servo which cause variation of the propeller blade pitch, so that turning said blades will cause displacement of the first rod 31 in relation to propeller drive shaft 11. The front end portion of first rod 31 projects from the front opening of the propeller drive shaft central bore, and has a circular front groove 32.

Through a coaxial bore in the vertical drive shaft a first tube 40 extends and is rotatable relative to said drive shaft, and may be mounted in said vertical drive shaft. A second rod 43 extends through first tube 40 and is rotatable relative to said tube. Second rod 43 may be mounted in tube 40 and has its lower portion firmly connected with a bracket 30 which is firmly connected with second housing 2.

As will appear from the first embodiment of the arrangement according to the invention, shown in FIG. 1, an arm 41 extends at lower end portion of the first tube, normal to the longitudinal axis thereof and firmly connected with said tube. Said arm 41 is, via a coupling link 42, linked with one end portion of a lever 33. Centrally, lever 33 has a pivot 34 by the aid of which it is journalled to bracket 30. The other end portion of lever 33 may be bifurcated, and be provided with one arm on each side of the first rod in groove 32.

A hydraulic control signal to the servo for turning the propeller blades will, thus, cause axial displacement of first rod 31 relative to propeller drive shaft 11, which will in turn cause lever 33 to turn, so that first tube 40 is turned, via coupling link 42.

As mentioned above, rotation of drive shaft 20 will cause rotation of second housing 2, which will in turn cause rotation of second rod 43. This last mentioned rotation is, thus, a function of the azimuth angle and may, e.g. via electrical transmitting means, be transmitted directly to a display means. It appears from FIG. 1 that rotation of the second housing will, however, also cause rotation of first tube 40. A change of the angle of attack of the propeller blades simultaneously with a change of the azimuth angle will cause rotation of first tube 40 relative to second rod 43. In order to display the angle of attack of the propeller blades it must, thus, be possible to sense any displacement of first tube 40 relative to second rod 43, in other words, the difference between the angular displacement of first tube 40 and second rod 43.

To this end, upper end portion of first tube 40, which projects from the vertical drive shaft 6, is provided with a gear 50 which is firmly connected with first tube 40, and upper end portion of second rod 43, which projects from first tube 40 has a gear 51 which is firmly connected with said end portion. Gear 51 is connected with first drive gear 53 of a differential 54, via a reversing gear 52, and gear 50 is connected with second drive gear 55 of the differential. The casing (not shown) of the differential may be firmly connected with, e.g. first housing 1, and reversing gear 52 may be pivoted in said housing or in the casing of the differential. A third rod 56 is firmly connected with the shaft on which the balancing gear 57, 58 of the differential is rotatably mounted, so that only different rotation of gears 50 and 51 will cause rotation of third rod 56. Such rotation of third rod 56 is, thus, a function of the angle of attack of the propeller blades and may be transmitted to a display means, e.g. via a transmitter not shown. The arrangement according to the invention shown in FIG. 2 differs from the above disclosed arrangement in that a pipe 60 which may be mounted in vertical drive shaft 6, is provided in a coaxial bore of vertical drive shaft 6 and is displaceable in the longitudinal direction of said shaft. Two arms of one end portion of a lever 61 are arranged, one at each side of first rod 31 in groove 32. Lever 61 is linked to bracket 30, via a pivot 62, so that lever 61 can rotate in a plane comprising the longitudinal axis of tube 60. Three arms 63, 64, 65 having one end portion linked together, via a common shaft 66, are at their other end portions linked to tube 60, bracket 30, and the other end portion of lever 61, respectively. As shown in FIG. 2, forward displacement of first rod 31 will cause arm 65 to move common shaft 66 rearwards which will, in turn, cause displacement upwards of tube 60, and vice versa.

Upper end portion of tube 60 has external circular grooves which are engaged with gear 67, the rotation of which is transmitted to a display means, e.g. via suitable members, not shown.

Even though a change of the azimuth angle without any change of the angle of attack of the propeller blades will cause rotation of tube 60, also in this arrangement according to the invention, such rotation will not cause rotation of gear 67 and will, thus, not affect the display of the angle of attack of the propeller blades.

I claim:

1. An azimuth propeller drive assembly for a ship to provide measurement of the azimuth angle and of the angle of attack of variable pitch propeller blades comprising:

azimuth propeller drive means for propelling the ship including a first housing, said housing being firmly connected with the ship, a second housing, said second housing being rotatably mounted to said first housing, a first drive shaft, said first drive shaft having a first coaxial bore, a first end and a second end, a tube extending through said first coaxial bore, said tube having an upper section and a lower section, said upper section extending beyond said first end and said lower section extending beyond said second end, said first end being connected to the engine of the ship, a first rod extending coaxially through the central bore of said tube and being rotatable relative to said tube, said first rod having an upper portion and a lower portion, said upper portion extending beyond said upper section and said lower portion extending beyond said lower section and being firmly connected within said second housing, said first drive shaft extending from connection with the engine through said first housing into said second housing, said second end being mounted inside said second housing, a second drive shaft having a second coaxial bore, a propeller end, and a drive end, said second drive shaft being engaged at said driving end for driving by said first drive shaft and extending from said driving end through a wall portion of said second housing with said propeller end being mounted with a propeller assembly, said propeller assembly having a plurality of variable pitch blades and a servo for varying the angle of attack of said plurality of variable pitch blades, a translation system located within said second housing, said translation system having a first operational end and a second operational end, a second rod extending within said second coaxial bore, said second rod having a servo end and a translation end, said servo end being linked to said servo, said translation end being linked to said first operational end, said second rod being axial displaceable along said second coaxial bore in response to varying the angle of attack of said plurality of variable pitch blades by said servo, said second operational end being connected to said lower section of said tube, and means for display of the angular displacement of said tube and of the angular displacement of said fist rod, said means being connected to said upper section of said tube and to said upper portion of said first rod;

whereby a variation of the angle of attack of said plurality of variable pitch blades will cause a corresponding axial displacement of said second rod which will cause a corresponding angular displacement of said tube, the corresponding angular displacement of said tube being displayed on said means for display;

and whereby rotation of said second housing relative to said first housing will cause a corresponding angular displacement of said first rod, the corresponding angular displacement of said first rod being displayed on said means for display.

2. An assembly according to clam 1, wherein said translation system is operable to cause said tube to be angularly displaced about the longitudinal axis of said tube in response to the axial displacement of said second rod relative to said second drive shaft.

3. An assembly according to claim 1, wherein said means for display includes a reversing gear, a first and a second connecting gear and a differential gear, said differential gear having a first and a second drive gear and a first and a second balancing gear, said balancing gears having a common axis of rotation, said first connecting gear being firmly connected to said upper section of said tube and being engaged with said second drive gear, said second connecting gear being firmly connected to said upper portion of said first rod and being engaged with said first driving gear via said reversing gear, the angular position of the common axis of rotation of said balancing gears relative to said first housing being a function of the angle of attack of said plurality of variable pitch blades, the angular position of said first rod being a function of the azimuth angle and the longitudinal axis of the ship.

4. An azimuth propeller drive assembly for a ship to provide measurement of the azimuth angle and of the angle of attack of variable pitch propeller blades comprising:

azimuth propeller drive means for propelling the ship including a first housing, said housing being firmly connected with the ship, a second housing, said second housing being rotatably mounted to said first housing, a first drive shaft, said first drive shaft having a fist coaxial bore, a first end and a second end, a tube extending through said first coaxial bore, said tube being axially displaceable relative to said first drive shaft, said tube having an upper section and a lower section, said upper section extending beyond said first end and said lower section extending beyond said second end, said first end being connected to the engine of the ship, a first rod extending coaxially through the central bore of said tube and being rotatable relative said tube, said first rod having an upper portion and a lower portion, said upper portion extending beyond said upper section and said lower portion extending beyond said lower section and being firmly connected within said second housing, said first drive shaft extending from connection with the engine through said first housing into said second housing, said second end being mounted inside said second housing, a second drive shaft having a second coaxial bore, a propeller end, and a driving end, said second drive shaft being engaged at said driving end for driving by said first drive shaft and extending from said driving end through a wall portion of said second housing with said propeller end being mounted with a propeller assembly, said propeller assembly having a plurality of variable pitch blades and a servo for varying the angle of attack of said plurality of variable pitch blades, a translation system located within said second housing, said translation system having a first operation end and a second operation end, a second rod extending within said second coaxial bore, said second rod having a servo end and a translation end, said servo end being linked to said servo, said translation end being linked to said first operational end, said second rod being axially displaceable along said second coaxial bore in response to varying the angle of attack of said plurality of variable pitch blades by said servo, said second operational end being connected to said lower section of said tube, and means for display of the axial displacement of said tube, said means being connected to said upper section of said tube;

whereby a variation of the angle of attack of said plurality of variable pitch blades will cause a corresponding axial displacement of said second rod which will cause a corresponding axial displacement of said tube, the corresponding axial displacement of said tube being displayed on said means for display.

and whereby rotation of said second housing relative to said first housing will cause a corresponding angular displacement of said first rod.

5. An assembly according to claim 4, wherein said translation system is operable to cause said tube to be axially displaced relative to said first drive shaft in response to axial displacement of said second rod relative to said second drive shaft.

6. An assembly according to claim 4, wherein said upper section has external circumferential grooves and said means for display includes a shaft and a gear, said gear being mounted on said shaft and being rotatably engaged with said grooves, the axial displacement position of said tube relative to said first drive shaft being a function of the angle of attack of said plurality of variable pitch blades.

* * * * *